US008640367B2

(12) United States Patent
Choi et al.

(10) Patent No.: US 8,640,367 B2
(45) Date of Patent: Feb. 4, 2014

(54) DIGITAL PRICE INDICATOR

(75) Inventors: Jae Yeon Choi, Seoul (KR); Yull Oh Kim, Seoul (KR); Yong Taek Oh, Seoul (KR); Ju Bong Park, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 136 days.

(21) Appl. No.: 13/073,440

(22) Filed: Mar. 28, 2011

(65) Prior Publication Data

US 2011/0239498 A1 Oct. 6, 2011

(30) Foreign Application Priority Data

Apr. 1, 2010 (KR) ..... 10-2010-0030089

(51) Int. Cl.
*G09F 13/00* (2006.01)

(52) U.S. Cl.
USPC ..... 40/541; 40/446

(58) Field of Classification Search
USPC ..... 40/299.01, 541, 657, 663; 340/10.6, 340/7.55; 361/600, 757
See application file for complete search history.

(56) References Cited

U.S. PATENT DOCUMENTS 5,461,809 A * 10/1995 Fowler et al. ..... 40/655
5,778,579 A * 7/1998 Yuen ..... 40/564
6,550,673 B2 * 4/2003 Massaro ..... 235/383
6,712,324 B2 * 3/2004 Catteau et al. ..... 248/222.51
6,897,763 B2 * 5/2005 Schulmerich et al. ..... 340/5.91
7,220,037 B2 * 5/2007 Petre ..... 362/570
8,141,283 B2 * 3/2012 Lee et al. ..... 40/655
8,142,061 B2 * 3/2012 Jablonski ..... 362/559
2004/0107616 A1 * 6/2004 Ko et al. ..... 40/550
2008/0257947 A1 * 10/2008 Guo et al. ..... 232/38
2009/0196028 A1 * 8/2009 Chao et al. ..... 362/183
2011/0025195 A1 * 2/2011 Govender ..... 313/504
2011/0031904 A1 * 2/2011 Carolan ..... 315/313
2011/0102155 A1 * 5/2011 Choi et al. ..... 340/10.6
2011/0265360 A1 * 11/2011 Podd et al. ..... 40/541
2011/0286195 A1 * 11/2011 Horikiri et al. ..... 361/807

FOREIGN PATENT DOCUMENTS

KR 10-2001-0009536 A 2/2001

* cited by examiner

*Primary Examiner* — Joanne Silbermann
*Assistant Examiner* — Christopher E Veraa
(74) *Attorney, Agent, or Firm* — Saliwanchik, Lloyd & Eisenschenk

(57) ABSTRACT

A digital price indicator is provided. In the digital price indicator, a display body is disposed on a front side of a fence installed on a shelf, a battery is disposed on a back side of the fence and supplies power to the display body, and a connection unit is installed at the display body and the battery to connect power between the display body and the battery and secure the display body and the battery to the fence. Accordingly, the display body can have a slim profile, an improvement in design and ease of battery change can be achieved, and battery capacity can be extended.

12 Claims, 4 Drawing Sheets

DIGITAL PRICE INDICATOR

CROSS-REFERENCE TO RELATED APPLICATION

This application claims the benefit under 35 U.S.C. §119 of Korean Patent Application No. 10-2010-0030089, filed on Apr. 1, 2010, which is hereby incorporated by reference in its entirety.

BACKGROUND

The present disclosure relates to a digital price indicator capable of displaying prices, specifications of products, and the like in real time.

Of late, retailers such as department stores or warehouse chains have displayed a large amount of products on shelves according to the development of distribution and logistics industry. Price indicators for displaying prices and information regarding products being displayed are mounted on the shelves.

A price indicator includes a plate fixed to a shelf, and a display panel detachably mounted on the plate and having a display region allowing for the display of a unit cost, a place of production, characteristics, promotional phrases, and the like. However, in most cases, a price indicator according to the related art has a plate fixed in location, which makes it very inconvenient for a clerk to change the location of the display panel.

Since the display panel of the price indicator according to the related art has a detachable structure, a customer may accidentally remove the display panel from the plate and lose it.

Furthermore, according to the related art price indicator, in order to manufacture display panels expressing various shapes, colors and characters in a single model, the display panels need to be manufactured differently for each product being displayed. This may bring about an extreme waste of materials since display panels need to be discarded in the case where there is a price change or a product is out of stock and no longer for sale.

BRIEF SUMMARY

Embodiments provide a digital price indicator capable of displaying a product price and information regarding a product in real time to thereby provide ease of use and facilitate an inventory count and a sales estimation.

Embodiments also provide a digital price indicator having a display body and a battery provided separately from each other to thereby achieve slimness of the display body, and an improved exterior design.

Embodiments also provide a digital price indicator having a display body and a battery provided separately from each other to thereby achieve ease of battery change and allow for the extension of battery capacity.

Additional advantages, objects, and features of the invention will be set forth in part in the description which follows and in part will become apparent to those having ordinary skill in the art upon examination of the following.

In one embodiment, a digital price indicator includes: a display body disposed on a front side of a fence installed on a shelf; a battery disposed on a back side of the fence and supplying power to the display body; and a connection unit installed at the display body and the battery, connecting power between the display body and the battery, and securing the display body and the battery to the fence.

The connection unit may include: a locking hook on a back side of the display body, the locking hook penetrating the fixing hole in the fence and in which a first power connection terminal is disposed; and a locking member on a front side of the battery, the locking member catching the locking hook therein and in which a second power connection terminal is disposed.

The connection unit may include: a first fixing member on a back side of the display body, the first fixing member being disposed on an outer circumferential surface of a first power connection terminal, penetrating the fixing hole in the fence, and having a male threaded part around an outer circumferential surface thereof; a second fixing member on a front side of the battery, the second fixing member in which a second power connection terminal is disposed; and a fixing ring securing the first fixing member and the second fixing member to each other.

In another embodiment, a display device for a digital price indicator, includes: a case fixed to a fence; a display module installed on a front side of the case and outputting images associated with a price, specifications and an advertisement of a product on a shelf while switching the images; a communication module installed in the case and communicating with a server via a wired or wireless network; and a micro processor unit installed in the case and controlling screen output of the display module and communication of the communication module.

The digital price indicator according to the present disclosure includes a display body disposed on the front side of a fence, a battery disposed on the back side of the fence, and a connection unit serving to secure the display body and the battery to the fence while connecting power therebetween. Accordingly, the display body can have a slim profile, ease of battery change can be achieved, and battery capacity can be extended.

The details of one or more embodiments are set forth in the accompanying drawings and the description below. Other features will be apparent from the description and drawings, and from the claims.

DETAILED DESCRIPTION

Reference will now be made in detail to the embodiments of the present disclosure, examples of which are illustrated in the accompanying drawings.

Hereinafter, a digital price indicator according to an embodiment will be described with reference to the accompanying drawings in detail.

Figure 1:
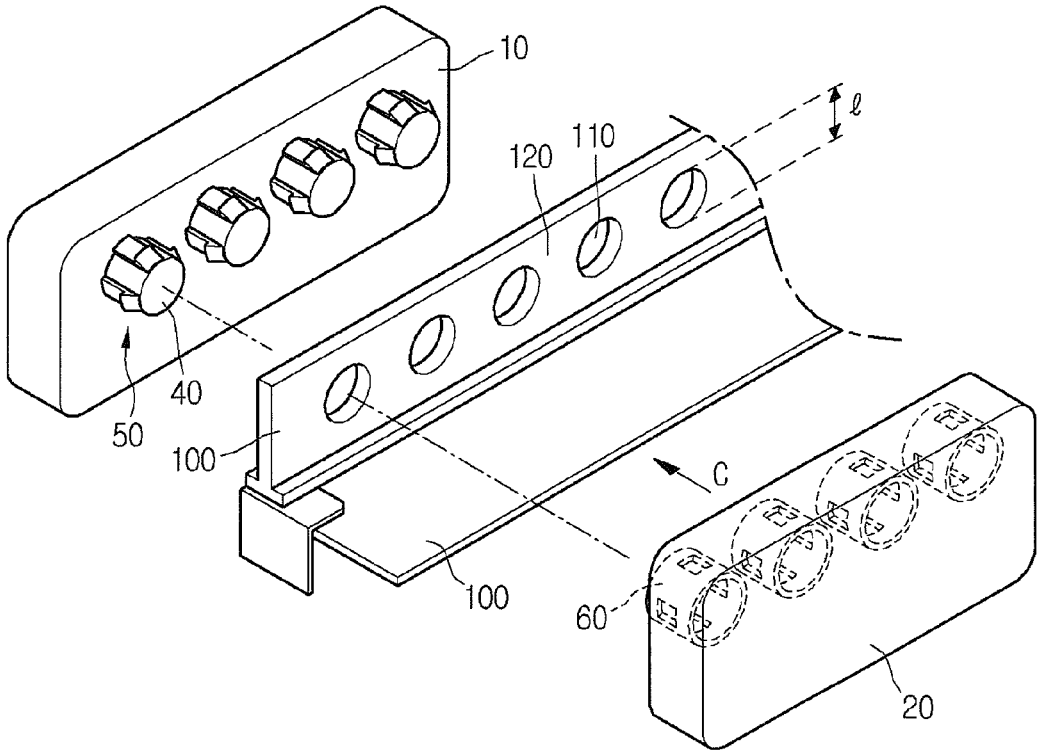
FIG. 1 is an exploded perspective view of a digital price indicator according to an embodiment.

FIG. 1 is an exploded perspective view illustrating a digital price indicator according to an embodiment. Referring to FIG. 1, a digital price indicator according to an embodiment includes a display body 10 fixed to a shelf 100 and displaying a product price, information regarding a product, and the like, and a battery 20 fixed to the shelf 100 and supplying power to the display body 10.

The display body 10 and the battery 20 are provided with a connection unit for fixing the display body 10 and the battery 20 to the shelf 100 while connecting power between the display body 10 and the battery 20. As will be described later, the connection unit includes locking hooks 50 and locking members 60.

The shelf 100 is provided with a fence 120 having fixing holes 110 each with a diameter of 1 to fix the display body 10 and the battery 20. The fixing holes 110 are formed in a longitudinal direction of the fence 120 at regular intervals.

The fixing holes 110 may be provided in the form of a circular hole, a long hole, or a slit having a predetermined width and elongated in the longitudinal direction of the fence 120.

The fence 120 is installed along the edge of the shelf 100 where products are displayed. The fence 120 serves as a partition wall preventing products from falling from the shelf 100 while serving as a support for mounting the digital price indicator.

The display body 10 is installed on the front side of the fence 120, and receives information regarding a product on the shelf 100, such as a price, specifications and advertising image thereof, from a server via a wired/wireless network.

The display body 10 may be additionally provided with a small-sized webcam, a sensor and the like connected to the server via a wired or wireless network, so that the inventory of products or the location of a desired product can be easily checked.

Figure 2:
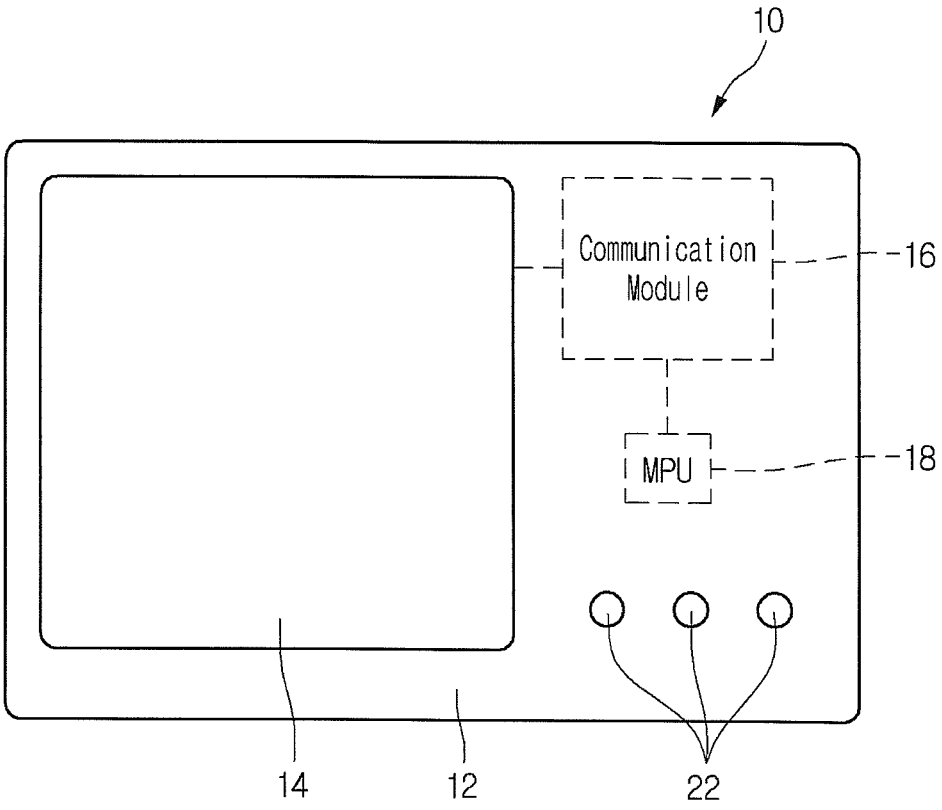
FIG. 2 is a front view of a display body according to an embodiment.

As shown in FIG. 2, the display body 10 may include a case 12, a display module 14 installed on the front side of the case 12 and displaying information, a communication module 16, a micro processor unit 18, and operation buttons 22.

The display module 14 is installed in the case 12. The display module 14 provides a screen for outputting images associated with a price, specifications and advertisement of a product on the shelf 100 while switching the images.

The communication module 16 is installed in the case 12. The communication module 16 receives information regarding the price and specifications of the product on the shelf 100, information regarding advertising images thereof, and the like from a server through wired or wireless network communications, and transmits the same to the display module 14.

The micro processor unit 18 is also installed in the case 12. The micro processor unit 18 controls a screen output process of the display module 14 and a communication process of the communication module 16, and performs a series of calculation according to the transmission and reception of an amount of information being processed in the screen output process and the communication process.

Such a display body 10 does not have a battery therein, which accordingly leads to a reduction in volume of the display body 10. In this a manner, the display body 10 can be slimmed down.

In more detail, considering that a display body protrudes forwardly from a fence, a display body having a large thickness may deteriorate the quality of appearance or come into contact with shoppers. However, according to this embodiment, the display body 10 can have a minimized thickness, thereby ensuring improved quality of appearance and preventing contact with people or another product.

The battery 20 is installed on the back side of the fence 120 to supply power to the display body 10. Here, the battery 20 includes a battery case 26, and a battery body 24 disposed inside the battery case 26.

The battery 20 is provided separately from the display body 10. This allows for an increase in the capacity of the battery 20, thereby ensuring long useful life of the battery. Furthermore, since only the battery is detached to change the battery, ease of battery change can be achieved.

Figure 3:
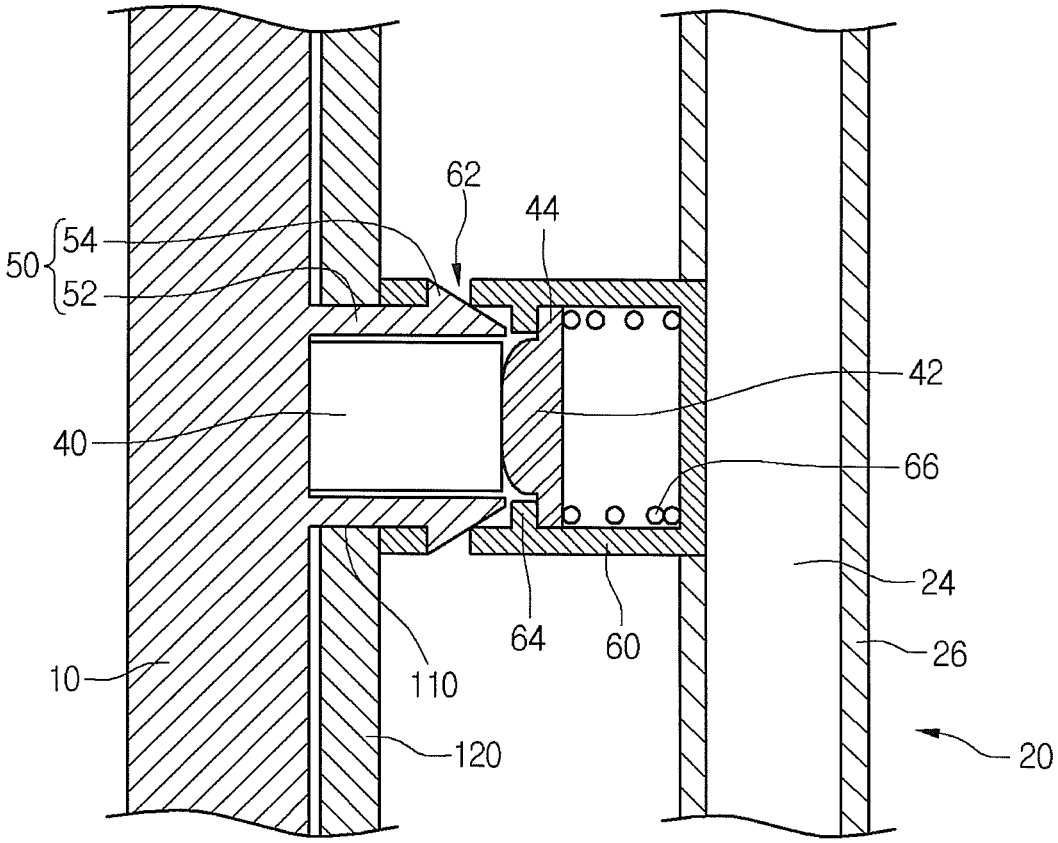
FIG. 3 is a cross-sectional view of a connection unit according to an embodiment.

FIG. 3 is a cross-sectional illustrating how the display body 10, the battery 20 and the shelf 100 are assembled.

Referring to FIG. 3, the connection unit, according to an embodiment, includes the locking hook 50 formed on the back side of the display body 10 and penetrating the fixing hole 120 formed in the fence 120, and the locking member 60 formed on the front side of the battery 20 and caught in the locking hook 50.

A first power connection terminal 40 protrudes from the back side of the display body 10. Also, the locking hook 50 is disposed around the outer circumferential surfaces of the first power connection terminals 40, respectively.

The locking hook 50 includes two or more ribs 52 separately disposed along the outer circumferential surface of the first power connection terminal 40 at regular intervals, and a hook part 54 extending outwardly from an end portion of each of the ribs 52.

The ribs 52 have their own elasticity so that the hook parts 54 remain caught in the locking member 60.

The first power connection terminal 40 has a cylindrical shape. As first power connection terminals 40, positive (+) and negative (−) terminals may be disposed at a predetermined interval therebetween. Referring to FIG. 1, four first power terminals 40 are illustrated, and each of the four first power terminals 40 and an adjacent one thereto may be paired up and connected to a positive (+) terminal and a negative (−) terminal of the battery body 24, respectively.

The locking member 60 is formed on the front side of the battery case 26 in the form of a cylinder, and has two or more locking holes 62 arranged at regular intervals in a circumferential direction thereof. The locking hooks 50 are caught in the locking holes 62, respectively. The front side of the locking member 60 comes into contact with the back side of the fence 120.

A second power connection terminal 42, connected to the battery body 24, is disposed inside the locking member 60 to be linearly movable. To prevent the second power connection terminal 42 from being separated from the locking member 60, a stopping projection 64 protrudes inwardly of the locking member 60 at an upper end portion of the locking member 60.

The second power connection terminal 42 has a top surface projecting outwardly from the locking member 60 so as to come into contact with the first power connection terminal 40. Also, a bottom surface of the second power connection terminal 42 has a stopping part 44 caught by the stopping projection 64.

Also, an elastic member 66 giving elasticity to the second power connection terminal 42 is disposed inside the locking member 60. The elastic member 66 is configured as a coil spring to elastically support the second power connection terminal 42 and thus enhance a contact force between the second power connection terminal 42 and the first power connection terminal 40.

In the above disclosure, the first power connection terminal 40 and the second power connection terminal 42 are disposed inside the locking hook 50 and the locking member 60, respectively. However, a structure where the first power connection terminal 40 and the second power connection terminal 42 are disposed separately from the locking hook 50 and the locking member 60 is also available.

As for the operation of the connection unit configured as above, as the display body 10 is disposed on the front side of the fence 120, the locking hooks 50 pass through the fixing holes 110 in the fence 120, respectively. Meanwhile, as the battery 20 is disposed on the back side of the fence 110, the hook parts 54 of the locking hooks 50 are inserted into the corresponding locking holes 62 of the locking members 60 and caught therein.

At this time, each locking hook 50 remains caught in the locking holes 62 due to the elasticity of the ribs 52 of the locking hook 50.

Also, the first power connection terminal 40 in the locking hook 50 and the second power connection terminal 42 in the locking member 60 come into contact with each other, thereby electrically connecting the battery 20 with the display body 10. In this case, since the second power connection terminal 42 is elastically supported by the elastic member 66, the second power connection terminal 42 can maintain its contact with the first power connection terminal 40.

Figure 4:
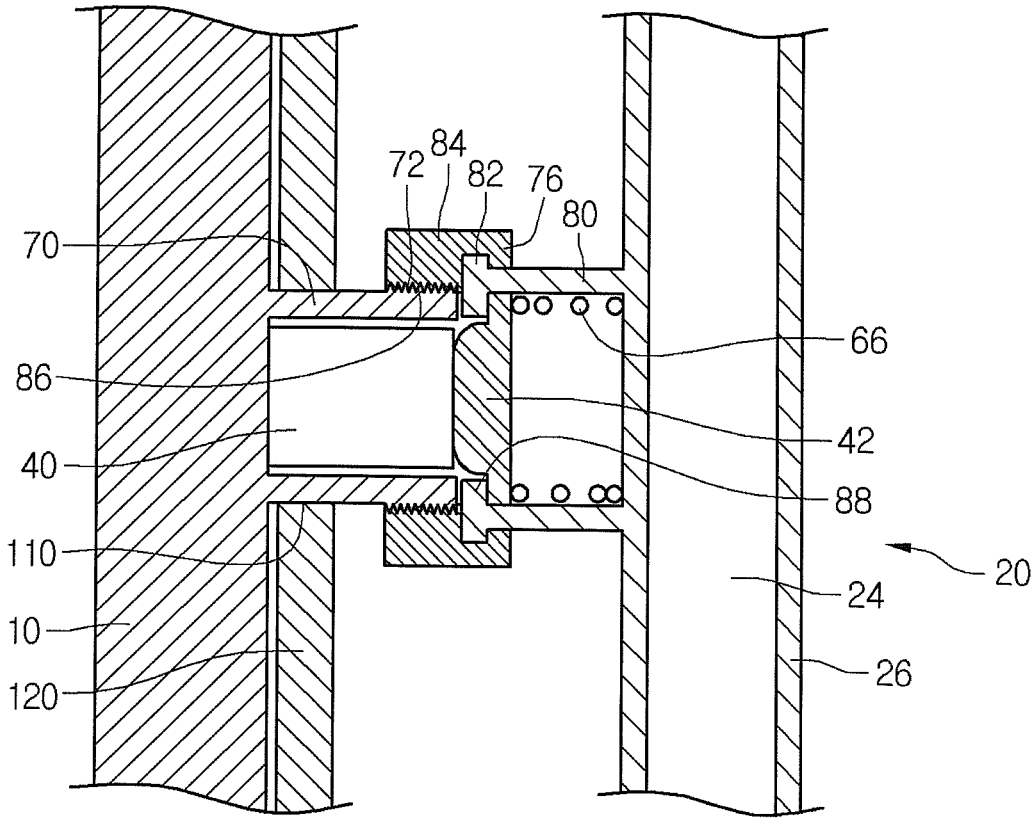
FIG. 4 is a cross-sectional view of a connection unit according to another embodiment.

FIG. 4 is a cross-sectional view of a connection unit according to another embodiment.

Referring to FIG. 4, a connection unit according to another embodiment includes a first fixing member 70, a second fixing member 80, and a fixing ring 84. The first fixing member 70 is provided on the back side of the display body 10, disposed on the outer circumferential surface of the first power connection terminal 40, and has a male threaded part 72 around its outer circumferential surface. The second fixing member 80 has a stopping projection 82 around its outer circumferential surface, and the second power connection terminal 42 is disposed inside the second fixing member 80 to be linearly movable. The fixing ring 84 is caught by the stopping projection 82 of the second fixing member 80, and is threadedly engaged with the male threaded part 72 of the first fixing member 70.

A detachment prevention protrusion 88 is provided on the top of the second fixing member 80 in order to prevent the second power connection terminal 42 from being separated. The elastic member 66 is disposed inside the second fixing member 80 in order to give elasticity to the second power connection terminal 42.

The fixing ring 84 has a stopping part 76 at its one end, and a female threaded part 86 at the other end portion in the inner circumferential surface of the fixing ring 84. The stopping part 76 protrudes inwardly of the fixing ring 84 to be caught by the stopping projection 82, and the female threaded part 86 is threadedly engaged with the male threaded part 72 of the first fixing member 70.

In the above disclosure, the first power connection terminal 40 and the second power connection terminal 42 are described as being disposed inside the first fixing member 70 and the second fixing member 80. However, a structure where the first power connection terminal 40 and the second power connection terminal 42 are disposed separately from the first fixing member 70 and the second fixing member 80 is also available.

As for a connection process of the connection unit according to another embodiment, the first fixing member 70 on the back side of the display body 10 penetrates the fixing hole 110 in the fence 120. Also, the second fixing member 80 on the front side of the battery 20 is disposed to face the first fixing member 70. Thereafter, the fixing ring 84 is fastened to engage the female threaded part 86 of the fixing ring 84 with the male threaded part 72 of the first fixing member 70. In such a manner, the first fixing member 70 is secured to the second fixing member 80.

In this case, the first power connection terminal 40 and the second power connection terminal 42 come into contact with each other, and thus the power is connected between the battery 20 and the display body 10. The second power connection terminal 42, elastically supported by the elastic member 66, enhances a contact force between two terminals.

As set forth herein, according to embodiments, the display body and the battery are configured to be individually fixed to the fence. Since the display body does not have a battery therein, a significant reduction in the thickness of the display body can be achieved.

Furthermore, since the battery is separable from the display body and thus does not require a size reduction, the capacity of the battery can be increased and a useful life thereof can be extended accordingly.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A digital price indicator comprising:

a display body disposed on a front side of a fence installed on a shelf;

a battery disposed on a back side of the fence and supplying power to the display body; and a connection unit installed at the display body and the battery, connecting power between the display body and the battery, and securing the display body and the battery to the fence;

wherein the fence is installed vertically on an edge of the shelf, and comprises a fixing hole in a longitudinal direction thereof, and wherein the connection unit comprises:

a locking hook on a back side of the display body, the locking hook penetrating the fixing hole in the fence and in which a first power connection terminal is disposed; and a locking member on a front side of the battery, the locking member catching the locking hook therein and in which a second power connection terminal is disposed.

2. The digital price indicator of claim 1, wherein the fixing hole of the fence is provided in a longitudinal direction of the fence in the form of a slit, a long hole, or circular holes arranged at regular intervals.

3. The digital price indicator of claim 1, wherein the display body comprises:

a case fixed to the fence;

a display module installed on a front side of the case and outputting images associated with a price, specifications and an advertisement of a product on the shelf while switching the images;

a communication module installed in the case and communicating with a server via a wired or wireless network; and a micro processor unit installed in the case and controlling screen output of the display module and communication of the communication module.

4. The digital price indicator of claim 1, wherein the locking hook comprises:

at least two ribs separately provided and having elasticity; and a hook part protruding outwardly from an end portion of each of the ribs.

5. The digital price indicator of claim 4, wherein the locking member has a cylindrical shape, and comprises a stopping hole in a circumferential direction of the locking member to catch the locking hook therein.

6. The digital price indicator of claim 5, wherein the second power connection terminal is disposed inside the locking member to be linearly movable, and the locking member comprises therein an elastic member giving elasticity to the second power connection terminal.

7. The digital price indicator of claim 6, wherein a stopping projection protrudes inwardly from an upper end portion of the locking member to prevent the second power connection terminal from being separated from the locking member.

8. A display device for a digital price indicator, the display device comprising:

a case fixed to a fence;

a display module installed on a front side of the case and outputting images associated with a price, specifications and an advertisement of a product on a shelf while switching the images;

a communication module installed in the case and communicating with a server via a wired or wireless network;

a micro processor unit installed in the case and controlling screen output of the display module and communication of the communication module;

a locking hook on a back side of the case, the locking hook penetrating a fixing hole in the fence and in which a first power connection terminal is disposed; and a locking member on a battery case, the locking member being to the locking hook.

9. The display device of claim 8, wherein the locking hook comprises:

at least two ribs separately provided and having elasticity; and a hook park protruding outwardly from an end portion of each of the ribs.

10. The display device of claim 8, wherein the locking member has a cylindrical shape, and comprises a stopping hole in a circumferential direction thereof to catch the locking hook therein.

11. The display device of claim 10, wherein a second power connection terminal of a battery is disposed in the locking member to be linearly movable, and an elastic member is provided in the locking member to give elasticity to the second power connection terminal.

12. The display device of claim 11, wherein the locking member comprises a stopping projection protruding inwardly from an upper end portion of the locking member to prevent the second power connection terminal from being separated from the locking member.

* * * * *